US007556554B2

(12) United States Patent
Brug et al.

(10) Patent No.: US 7,556,554 B2
(45) Date of Patent: Jul. 7, 2009

(54) APPARATUS AND METHOD FOR MANUFACTURING OPTICAL OBJECTS

(75) Inventors: Hedser van Brug, Den Haag (NL); Hugo Anton Marie de Haan, Son (NL); Jacobus Johannes Korpershoek, Schiedam (NL); Ian J. Saunders, Amsterdam (NL)

(73) Assignee: Nederlandse Organistie voor toegepastnatuurwetenschappelijk Onderzoek TNO, VK Delft (NL)

( * ) Notice: Subject to any disclaimer, the term of this patent is extended or adjusted under 35 U.S.C. 154(b) by 213 days.

(21) Appl. No.: 10/541,003

(22) PCT Filed: Dec. 30, 2003

(86) PCT No.: PCT/NL03/00946

§ 371 (c)(1),
(2), (4) Date: Sep. 28, 2005

(87) PCT Pub. No.: WO2004/058452

PCT Pub. Date: Jul. 15, 2004

(65) Prior Publication Data

US 2006/0079157 A1 Apr. 13, 2006

(30) Foreign Application Priority Data

Dec. 31, 2002 (NL) ..... 1022293

(51) Int. Cl.
*B24B 49/00* (2006.01)
*B24B 51/00* (2006.01)
*B24C 5/04* (2006.01)

(52) U.S. Cl. ..... 451/2; 356/239.2; 356/239.7; 356/511; 451/6; 451/8; 451/102

(58) Field of Classification Search ..... 356/239.1, 356/432, 239.2, 239.7, 237.2, 511; 451/2, 451/6, 8, 10, 11, 41–44, 65, 66, 67, 68, 69, 451/70, 71, 75, 99, 100, 102
See application file for complete search history.

(56) References Cited

U.S. PATENT DOCUMENTS

| | | | | |
|---|---|---|---|---|
| 5,067,282 | A * | 11/1991 | Netzel | 451/11 |
| 5,573,446 | A | 11/1996 | Dey et al. | |
| 5,649,849 | A * | 7/1997 | Pileri et al. | 451/1 |
| 5,700,181 | A | 12/1997 | Hashish et al. | |
| 6,032,377 | A * | 3/2000 | Ichikawa et al. | 33/554 |
| 6,301,009 | B1 | 10/2001 | Tinker | |
| 6,887,125 | B2 * | 5/2005 | Kurogouchi | 451/5 |
| 6,889,112 | B2 * | 5/2005 | Endoh et al. | 700/164 |
| 7,121,922 | B2 * | 10/2006 | van Brug | 451/6 |

FOREIGN PATENT DOCUMENTS

| | | |
|---|---|---|
| DE | 101 13 599 A1 | 10/2002 |
| GB | 865132 | 4/1961 |
| JP | 05318287 | 12/1993 |
| WO | WO 99/26764 | 6/1999 |

* cited by examiner

*Primary Examiner*—Timothy V Eley
(74) *Attorney, Agent, or Firm*—Hoffmann & Baron, LLP

(57) ABSTRACT

The invention relates to an apparatus for forming or working optical elements and/or optical forming elements (1) comprising a working apparatus (18) for forming surfaces of form parts by machining or an abrasive technique, wherein at least one measuring device (17) is provided for measuring changes in form and/or surface roughness of said surface when said surface is being worked and, on the basis thereof controlling said working apparatus (18).

21 Claims, 8 Drawing Sheets

APPARATUS AND METHOD FOR MANUFACTURING OPTICAL OBJECTS

This application is the U.S. National Phase of International Application Number PCT/NL2003/000946 filed on Dec. 30, 2003, which is incorporated herein by reference.

The invention relates to an apparatus for forming or working optical elements and/or optical forming elements.

The invention further relates to a method for forming or working optical elements and/or forming elements.

Further, the invention relates to optical elements or forming elements therefor such as molds.

BACKGROUND OF THE INVENTION

It is known from practice to manufacture optical elements and/or forming elements such as lenses, spectacle glasses, molds and the like from a pre-form, manufactured from, for instance, organic or mineral glass which pre-form, on a first side, has a substantially flat or slightly concave, spherical surface with a relatively large bending radius, and, on a second, opposite side, a convex surface with a relatively small bending radius. The convexity of, in particular, the second surface is selected depending on the strength of the desired eventual element such as frame, frame curve and glass curve and of the power of a spectacle glass with respect to myopia (nearsightedness) and hyperopia.

The first surface of this pre-form is milled in a milling machine suitable to that end, while the pre-form is rotated at high speed and the central thickness is reduced and a spherical surface is milled away, so that the radius of the concave surface is reduced. After, approximately, the desired form is obtained, the resulting surface is ground and polished, in order to obtain the desired shape and finish. This polishing is done with a polishing form which is pressed against the surface and which approximately has the desired ultimate shape, whereupon optical element and/or polishing form are rotated relative to each other.

In this known method, relatively much material is removed while during polishing, each time, the polishing form is to be removed to enable measurement and examination of the surface and central thickness, whereupon, if desired, polishing is continued before the optical element is removed from the blocker. This is why this manufacturing method is relatively expensive, labor intensive, time consuming and not always sufficiently accurate. Use of a polishing form is then disadvantageous because with it, at least on a first side, only symmetrically ground, substantially spherical or toric surfaces with parabolic or hyperbolic cross sections can be obtained. Further, this method is not particularly suitable for grinding and polishing highly concave surfaces.

Further, it is known from practice to use pre-form optical elements which, on the whole, already have the outer contour of the desired optical element. Here, both the first (aspherical) and the second surface (aspherical or toric) are of curved design, and by substantially adding material or removing through polishing, in the above-described manner, the curvature of the concave side of the pre-form can be adapted so as to obtain the desired optical element, particularly intended for nearsightedness or semi-nearsightedness. For this method too, it holds that it is relatively expensive and time-consuming and, moreover, not always sufficiently accurate, while furthermore, each time, intermediate measurements are to be performed, during which the element is to be taken from a holder and the operation is to be stopped.

In this description, optical elements are at least understood to include, in particular, spectacle glasses and contact lenses but also optical elements such as lenses for (precision) optics, mirrors and the like. Optical forming elements are at least understood to include forming elements such as molds, machining and non-machining folding tools and the like. The optical elements, optical forming elements and pre-forms thereto may together be indicated as optical objects. The examples given hereinabove should not be construed to be limitative in any way.

The invention contemplates an apparatus for forming and/or working optical elements and/or optical forming elements, with which at least a number of the drawbacks of the state of the art can be obviated.

A further object of the invention is to provide such an apparatus with which optical elements and/or forming elements can be manufactured and/or worked in a rapid and reliable manner.

A further object according to the invention is to provide such an apparatus with which from a limited number of pre-forms, a large number of different optical elements can be obtained.

A further object of the invention is to provide such an apparatus with which indication means, identification means and the like can be provided.

A still further object of the invention is to provide in an apparatus with which optical elements, in particular spectacle glasses and/or contact lenses can be made to measure, in particular matching eye dimensions and/or frame dimensions.

The invention further contemplates providing methods for accurately manufacturing or working optical elements and/or optical forming elements, in particular relatively complex elements in a simple and rapid manner.

The invention further contemplates providing optical elements and/or optical forming elements with relatively complex shapes and surfaces.

These and many objects are achieved according to the invention with the aid of an apparatus, method and optical (forming) element, respectively, as embodied in the claims.

SUMMARY OF THE INVENTION

With an apparatus according to the invention are provided:

- a working apparatus for forming, at least working, surfaces of form parts such as pre-forms, lenses, molds and the like by a machining or, preferably, an abrasive technique;
- at least one measuring device with which, when a surface is being worked, changes in form and/or changes in surface roughness of this surface can be measured; and
- means for operating the working apparatus on the basis of the measured changes.

With an apparatus according to the invention, during working of a surface, instantaneously, in situ, the change in form and/or surface roughness can be determined by, for instance, measuring changes in thickness and/or in surface roughness, so that, each time, the working apparatus can be controlled in a suitable manner for obtaining the desired local change of the respective surface. As a result, operations can be carried out rapidly and efficiently, milling, grinding and/or polishing operations can, for instance, be integrated, the element to be formed needs not be removed repeatedly and/or the operation needs not be stopped for carrying out measurements. Moreover, thus, the advantage is achieved that the element to be formed does not change positions when it is worked, so that, relative to one initial form, measuring and working can take place both absolutely and relatively, thereby increasing the versatility of the apparatus and the accuracy of the operations.

Preferably, each time, measuring takes place there where the working apparatus performs an operation, or in the direct vicinity thereof. More in particular, a relatively large part of the surface, preferably virtually the entire surface to be worked is measured so that, each time, the form of the entire surface can be monitored. With this, the advantage can be achieved that, for instance, changes in form on positions where no working takes place can also be observed and that the working apparatus can take this into account when working further.

With an apparatus according to the invention, preferably, use is made of light in the measuring device, more in particular interference measurements and/or scatterometry. In particular with optical elements and optical forming elements, this has proven particularly advantageous since refraction and reflection by the optical elements allow interference measurements and scatterometry particularly well.

With an apparatus according to the invention, preferably, the working apparatus is provided with at least one jet nozzle from which, under pressure, a blasting agent can be dispensed for an abrasive operation such as forming and polishing. Such a device can for instance be a jet stream polishing device. As a blasting agent, use can be made of a fluid with an abrasive agent included therein such as oxides, sand, glass, ice, mineral, ceramic, metal, allow or such particles, which can, for instance, be selected according to whether a machining property or a polishing property is desired. With such a device, abrasive operation can be carried out, also locally, in a rapid and accurate manner, without the respective surface as a whole needing to have a rotational symmetry. Also, powder jet techniques can be used.

Preferably, the apparatus is provided with a holder for the object to be worked, which holder is at least partly translucent, the measuring device being arranged for measuring, through the holder and the object, changes in form, in particular in the surface facing away from the holder. With this, in a particularly simple manner, measurement of surface changes can be carried out on the position where an operation is carried out or in the direct vicinity thereof. The fact is that the light, at least the waves with which the measurement is carried out, needs not pass the machining apparatus. By including at least one lens in the holder, in particular a Fresnel lens, the additional advantage is achieved that the measuring device can be designed to be particularly small and compact and, as a whole, can measure a relatively large object through a relatively small holder.

In an apparatus according to the invention, milling means, polishing means, grinding means and the like can be provided and preferably a combination thereof, more in particular such that with the different devices, operations can be carried out on one optical object, without this, intermediately, needing to be intermediately repositioned relative to the measuring device. An apparatus according to the invention can be used for both conventional operations and the working methods described hereinabove. As a result, rapidly and efficiently, a number of operations can be performed in sequence.

Use of a jet polishing means offers the advantage that operations on the surface can be carried out accurately and relatively locally, so that for instance recesses of limited dimensions can be provided, surface parts of relatively small sizes can be removed and the like. With an exact measurement and a relatively simple operation, a desired precision for the respective optical means can already be obtained. Also, with this, the advantage is achieved that the optical object and/or the working device such as a milling head, grinding head or polishing head needs not be rotated for the operation, at least not over a multiple of 360 degrees, so that non-rotation symmetrical objects can also be formed or worked.

With an apparatus according to the invention, for instance also a great variety of multi-focal lenses can be manufactured from a limited number of pre-forms. The fact is that starting from a standard pre-form, having or not having an aspherical portion, with the aid of a device, material can be removed locally, so that there, the refraction of the lens can be adjusted, so that a, for instance, principally negative lens can be made more or less negative or even positive, or the other way around. As a result of the use of an abrasive device, in particular a jet polishing device, relatively deep and local recesses can be provided, with any desired form and size, while with the aid of the measuring device, each time in situ, the change in form can be determined and adjusted.

In a comparable manner and with comparable means, also, metal or glass molds, required for the manufacture of preforms can be obtained, at least worked.

It is then preferred, that with an apparatus according to the invention, also lenses or the like can be made to measure for, for instance, a frame of a pair of spectacles or of an optical instrument. With this, in one apparatus, leases can be ready-made to be placed by or for an end user.

Preferably, damping means, at least vibration insulating means are provided which prevent the measuring device from being affected by vibrations generated by the working apparatus. These means can for instance be active vibration dampers, such as low frequency active or high frequency active dampers, white furthermore, the working apparatus and/or the measuring device and/or the holder for the object to be worked can be arranged separate from each other, for instance on one or more robot arms, which are arranged in a vibration low relation relative to each other.

The working apparatus can be provided with several jet openings for working different parts of a surface simultaneously, while the measuring means are arranged for measuring the changes in form, at least reductions in thickness on each of the positions where operations are carried out, and adjusting, individually or group-wise, the respective blow openings, at least jets exiting therefrom, for instance by adjusting flow rate, speed, direction and/or pressure or such parameters of a blasting device, preferably with known, specifically defined outflow pattern and surface, in particular a jet polishing device.

The invention further relates to a method for working optical elements and/or optical forming elements, wherein an optical element is placed in or on a holder such that a surface to be worked lies substantially clear from the holder, whereupon, with the aid of a working apparatus designed for carrying out an abrasive method, said surface to be worked is worked such that at least locally, the thickness of the element decreases while simultaneously, the thickness of the element at least at the location of the momentaneously worked surface part is measured and the working apparatus is controlled on the basis of the measured thickness, at least reduction thereof as a result of the abrasive method.

With such a method, rapidly, simply and accurately, optical objects can be worked and/or formed.

The invention further relates to optical objects provided with a first surface and an opposite, second curved surface, wherein on the second surface, locally, an elevation has been provided while in the first surface, approximately opposite said elevation, a recess and/or protuberance has been provided. Additionally, the first and the second surface can be of curved design, concave and convex, respectively, and substantially of spherical, toric, parabolic or hyperbolic shape each with an apex, while the elevation and/or the recess and/or the protuberance have been provided at a distance from the apex.

In the further subclaims, further advantageous embodiments of an apparatus, method and optical objects according to the invention are described.

BRIEF DESCRIPTION OF THE DRAWINGS

In clarification of the invention, embodiments of apparatus, methods and optical objects according to the invention will be further described with reference to the drawing, which are only shown by way of illustration and should not be construed to be limitative in any manner. In the Figures.

DETAILED DESCRIPTION OF THE INVENTION

Figure 1:
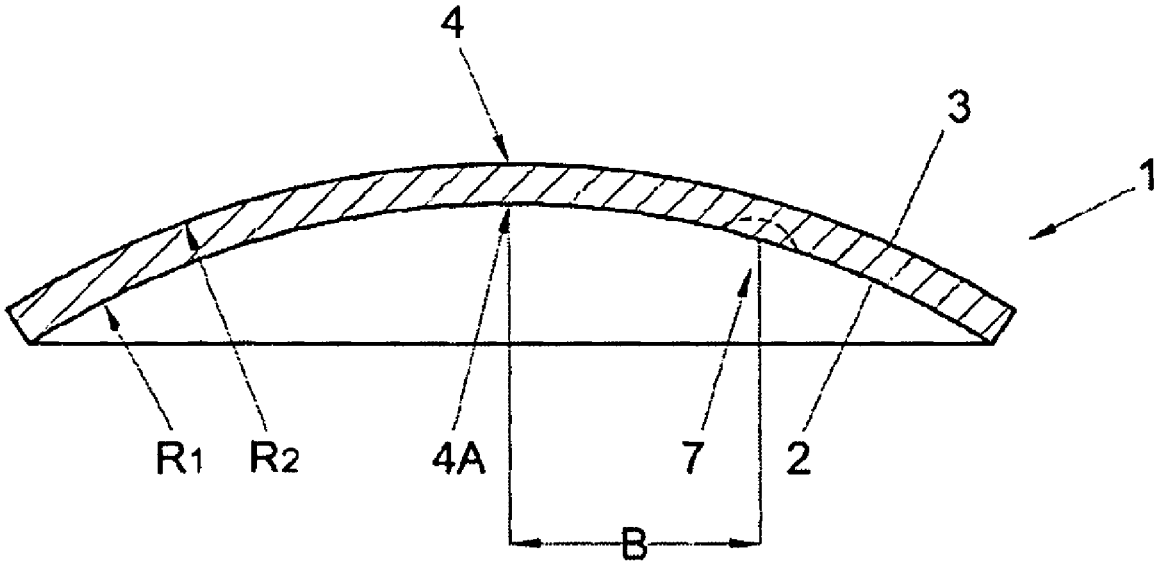
FIG. 1 shows a cross section of a first embodiment of a pre-form for an optical element.

In this description, identical or corresponding parts have identical or corresponding reference numerals. In this description, as examples, mainly apparatus and methods are described for forming optical objects such as lenses, more in particular ophthalmic objects such as spectacle glasses and contact lenses, and forming elements therefor such as molds and parts thereof. However, such apparatus and methods can also be used for other optical elements, for instance precision optics, mirrors and the like. Optical elements and optical forming elements also be further indicated as optical objects. The optical objects shown in the drawing have substantially circular aspects. From them, if desired, final objects such as spectacle glasses can be cut. However, the optical objects and the pre-forms therefor can naturally also have different forms.

In FIG. 1, a pre-form 1 for an optical element is shown, in cross section. This pre-form 1 is manufactured from, for instance, transparent plastic such as polycarbonate or from glass, and has a curved first surface 2 with a first bending radius R1 and a second surface 3, also curved, with a second bending radius R2. By varying the bending radiuses R1 and R2, naturally, the power of the pre-form, at least the optical element 1 can be determined and varied. In this embodiment, the first and second surface 2, 3 are substantially spherical, at least, have, substantially, a parabola or hyperbola as cross-sectional aspect, while the first surface 2 is concave and the second surface 3 is convex.

Figure 2:
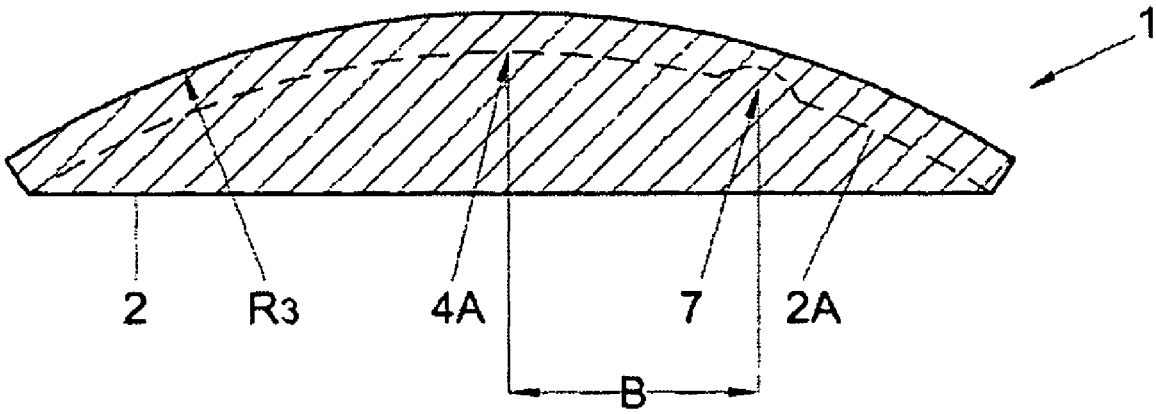
FIG. 2 shows a cross section of a second embodiment of a pre-form for an optical element.

In FIG. 2, a first alternative embodiment of a pre-form 1 according to the invention is shown, wherein the first surface 2 is substantially flat and the second surface 3 is curved, with a bending radius R3 such that this is convex. Herein, particularly with parabolic or hyperbolic cross sections, bending radius R is understood to include the local bending radius of a surface segment in the respective surface 2, 3.

Naturally, the first and or second surfaces of the pre-forms shown can, as desired, be of convex and/or concave design.

Figure 3:
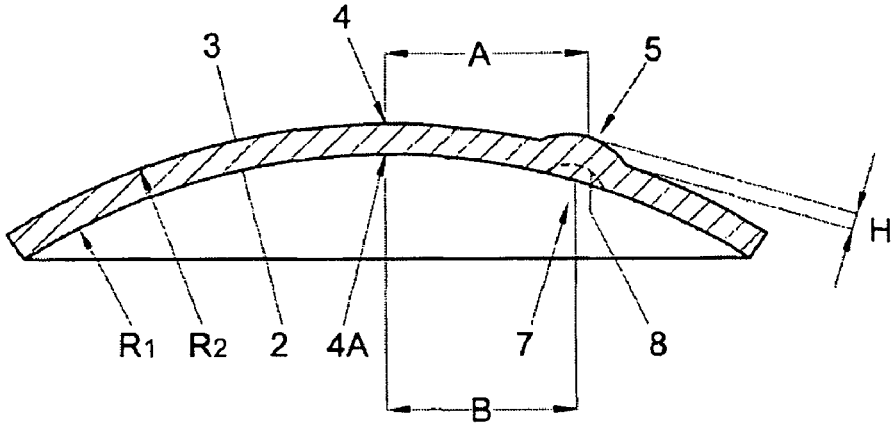
FIG. 3 shows a cross section of a third embodiment of a pre-form for an optical element.

In FIG. 3, in cross-sectional view, a third embodiment of a pre-form 1 according to the invention is shown, comparable to that of FIG. 1, wherein, however, on the second surface, at a distance A from the apex 4 thereof, an elevation 5 is provided, a protuberance which is integrally formed with the pre-form. The height H of this elevation can be selected as desired. It will be clear that the refraction at the height of the elevation 5 will be different from that of parts located immediately next to it of the optical element.

Figure 4:
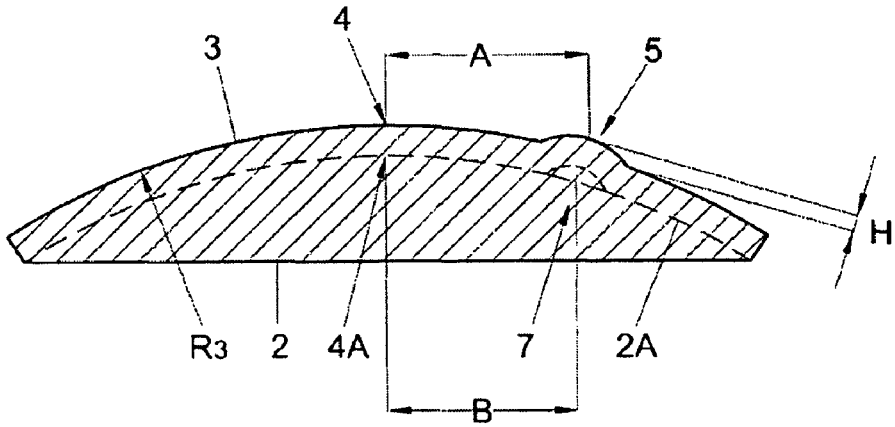
FIG. 4 shows a cross section of a fourth embodiment of a pre-form for an optical element.

In FIG. 4 in cross-sectional side view, a pre-form 1 is shown, comparable to that according to FIG. 2, wherein, however, once more, an elevation 5 is provided on the second surface 3, at a distance from the apex 4, once more with a height H to be selected as desired.

Figure 5:
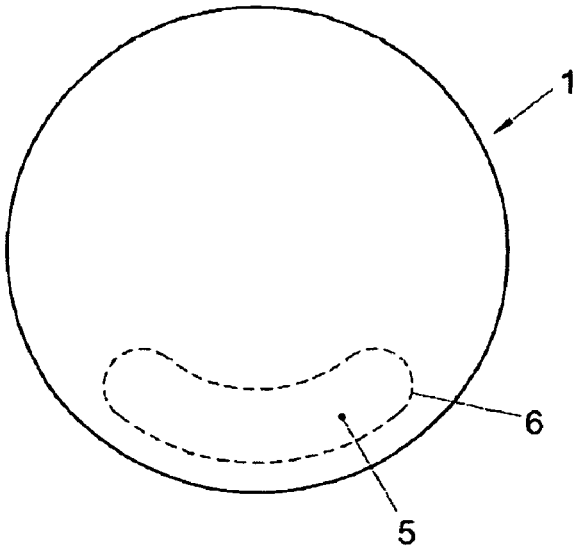
FIG. 5 shows, in top plan view, a pre-form or optical element according to any one of FIGS. 1-4, in particular according to FIG. 3 or 4.

FIG. 5 shows, in top plan view, a pre-form 1 according to any one of FIGS. 1-4, wherein, in interrupted lines, a possible contour 6 of the elevation 5 is shown. Naturally, this contour can have any suitable form, as can the cross section of the elevation, depending on the optical element to be formed.

From a pre-form 1 according to any one of FIGS. 1-4, an optical element can be formed by making it to measure with the aid of, for instance, milling, grinding and polishing techniques. From the pre-form 1 according to FIG. 2 or 4, in a known manner, a large part is then milled away from the side of the first surface, so that a concave first surface 2A is obtained as drawn in FIGS. 2 and 4 in interrupted lines. According to the invention, preferably, in the first surface 2, 2A, a recess 7 is provided at a distance B from the apex 4A of the respective surface, so that locally, the refraction of the optical element (the pre-form 1 and/or an object such as a spectacle glass to be formed therefrom) is influenced. Naturally, in a comparable manner, instead thereof or in addition thereto, a recess can be provided in the opposite second surface 3.

In the embodiment shown in FIGS. 3 and 4, the first surface is of continuous design, i.e. without recess, since on the opposite, second surface 3, an elevation 5 has already been provided. However, also in these embodiments, a recess 7 can be provided, as schematically indicated by the broken line 8, for further influencing the refraction of the optical element. The distances A and B can then be selected to be such that the recess and elevation 7, 5 are located directed one above the other, but also such, that they are slightly shifted relative to each other, for influencing the refraction in a specific manner.

Use of recesses 7 and/or elevations 5 according to the invention offer the advantage that, particularly, multifocal lenses such as spectacle glasses can be manufactured, while moreover, from a particularly small number of types of pre-forms a particularly great variety of lenses can be manufactured, to measure for the intended use. For instance, approximately one fifth of the normally required number of pre-forms can suffice. Naturally, also the elevation 5 can be adjusted by removing or adding material.

Figure 6:
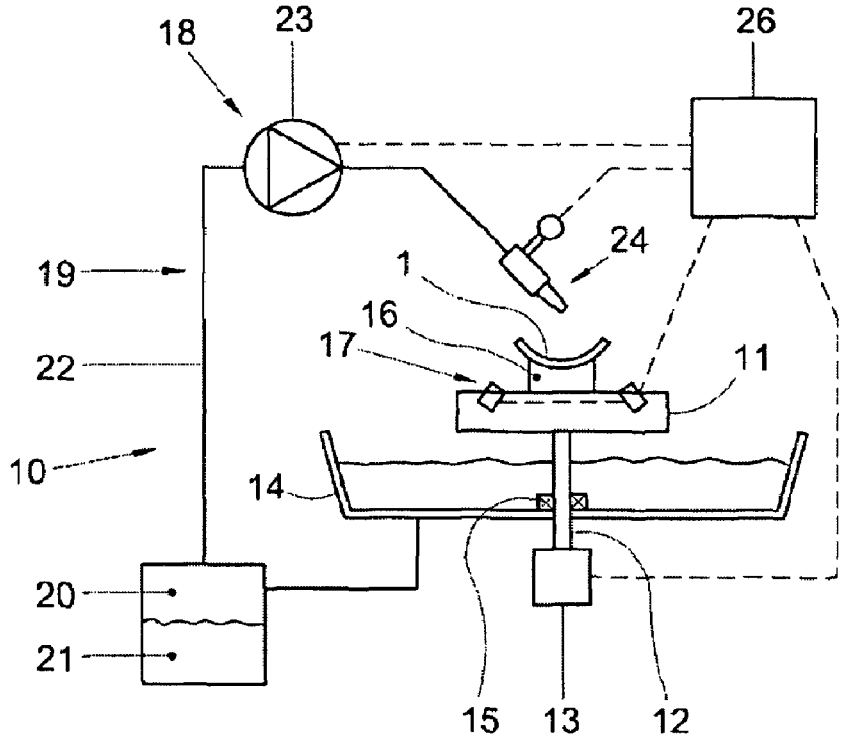
FIG. 6 schematically shows an apparatus according to the invention, in a first embodiment.
Figure 7:
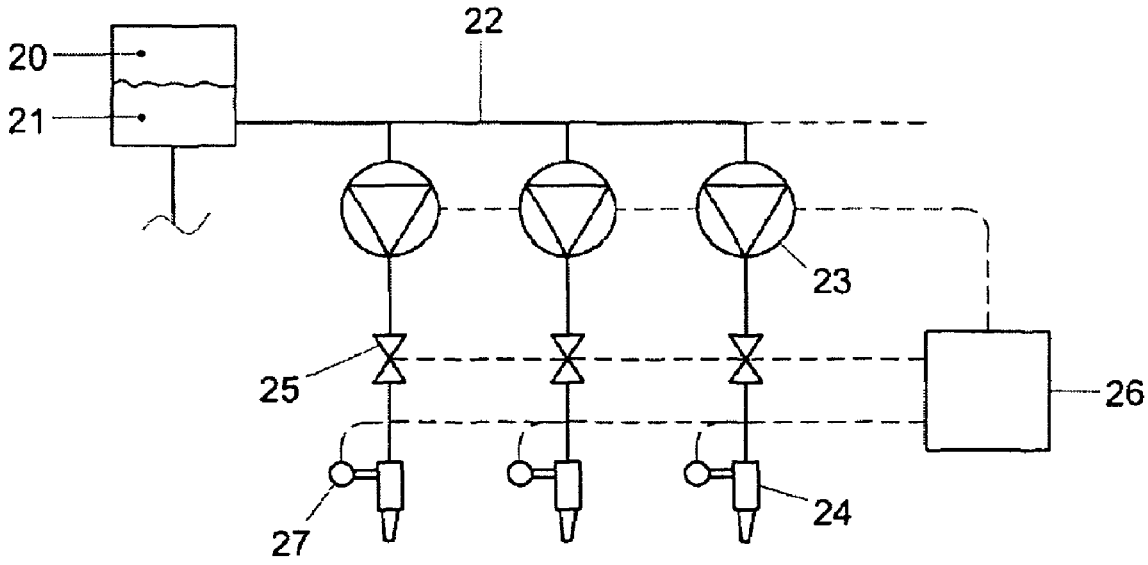
FIG. 7 schematically shows a part of an apparatus according to the invention, in a second embodiment.
Figure 11:
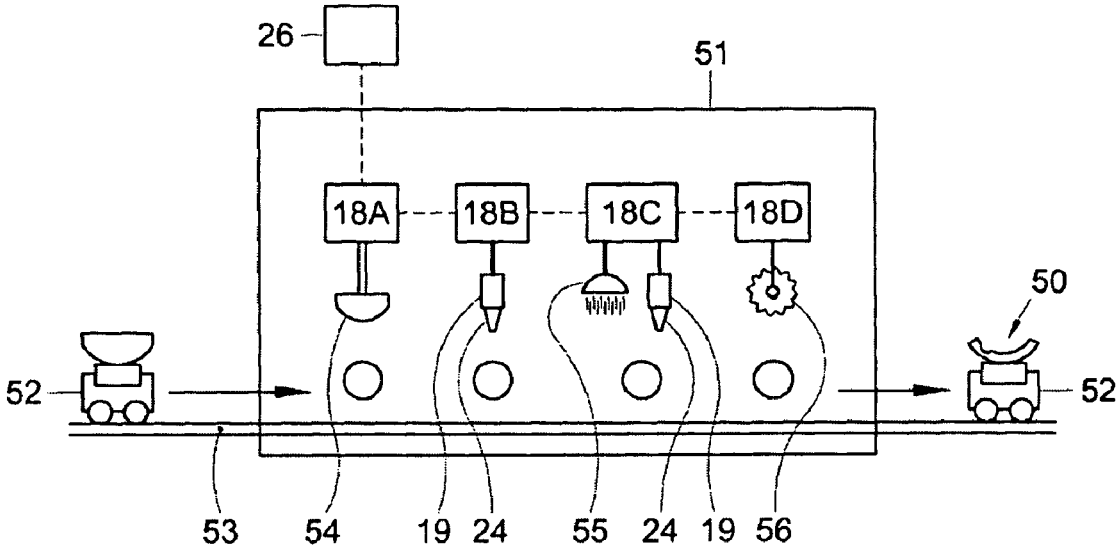
FIG. 11 schematically shows a further alternative embodiment of an apparatus according to the invention.

Pre-forms can be worked with standard working methods such as milling and polishing, but it is preferred that an apparatus according to the invention be used such as shown in, for instance, FIG. 6, 7 or 11, details of which are shown in the further Figures.

In FIG. 6, schematically, an apparatus 10 according to the invention is shown, with which pre-forms 1 can be worked in a simple and accurate manner. This apparatus 10 comprises a table 11 which can be rotated by a shaft 12 which is driven by a motor 13. The shaft 12 extends through the bottom of a tray 14, in which it is mounted by way of bearing 15. The table 11 extends above the tray 14 and is provided at the top side with a holder 16 as will be further described, on which, with means suitable to that end, an optical element such as a pre-form 1 can be secured, for instance with an adhesive compound/component. In or on the table 11, measuring means 17 are included with which in situ changes in form and particularly in thickness in the optical element can be measured. These measuring means will be further elucidated.

For measuring surface roughness and/or changes therein, in an advantageous manner, use can be made of scatterometry, instead of or in addition to interference measurement.

The apparatus 10 is further provided with a working device 18 for abrasively working the optical element, in particular in a force-controlled manner. In particular, as an example, a fluid jet device 19 is shown, in particular suited for polishing. This device 19 comprises a holder 20 for a liquid blasting agent 21, for instance a mixture of a liquid such as water and an abrasive agent such as sand, glass, ice, oxides, mineral, ceramic, metal, alloys, metal powder, plastic or such blasting agents known per se. The nature and size of the particles, at least of the blasting agent can for instance be selected according to whether, in particular, a machining property or, conversely, a polishing property is desired. To the holder a duct 22 is connected which is connected, via a pump 23, to a jet nozzle 24 with which, under pressure, a blasting agent 21 can be projected to the optical element for abrasively working this, in particular abstracting material therefrom for forming, for instance, a recess 7, for locally adjusting the bending radius R and/or influencing the surface roughness. The blasting agent 21 can be collected in the tray 14 and be returned to the holder 20. Such an device 19 offers the advantage that with it, in an accurate and rapid manner, surfaces can be worked particularly locally, for instance for forming recesses 7 with relatively large depth and small surface, or adjusting elevations 5.

In an alternative embodiment, with the aid of a known powder jet technique, the or a surface can be pre-treated. Powder blasting offers the advantage that with this, in a rapid and simple manner, a relatively rough operation can be carried out whereafter, in the manner described hereinabove, the desired form and/or surface roughness can be obtained.

In FIG. 7, an alternative embodiment of a part of a jet device 19 according to the invention is shown, wherein a series of jet nozzles 24 is shown, each connected, via a pump 23, to a holder 20 for blasting agent 21. Between each pump 23 and jet nozzle 24, a control valve or such control member 25 is provided with which, separately, the abrasive process can be adjusted. The fact is that with the aid of a control unit 26, as shown in FIG. 6 too, the pumps 23, control valves 25 and jet nozzles 24 can be controlled, for instance for controlling pressure, flow rate, blasting/jet direction and the like. With such a device a larger surface can be worked more rapidly. To that end, the jet nozzles 24 are fitted on drivable pivot means 27.

Naturally, groups of jet nozzles 24 can also be driven together. By adjusting or exchanging the jet nozzles 24, the outflow profiles and, hence, the working surfaces can be adjusted.

In FIGS. 7A-D, schematically, four embodiments of an apparatus according to FIG. 7 are shown.

Figure 7A:
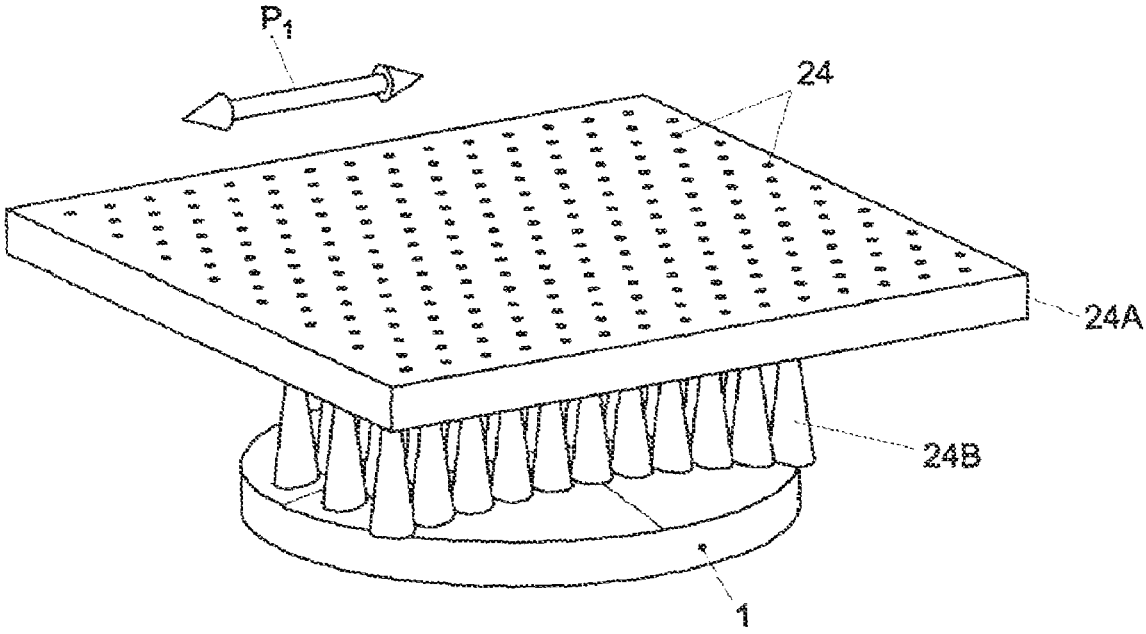
FIGS. 7A-D schematically show four embodiments of an apparatus according to FIG. 7.

FIG. 7A shows an embodiment wherein a matrix of jet nozzles 24, for instance jet openings, is included in a plate-shaped part 24A. An object 1 to be worked is arranged beneath it. As appears from the Figure, the jet nozzles 24 have a conical blasting pattern 24B such that the entire surface of the object 1 is contacted by it. With it, an entire surface can be worked in one go. Optionally, the part 24A can be adjusted in form to the surface to be worked, for instance with a comparable elevation or recess, so that each time, the distance between the jet nozzles 24 and the surface remains approximately the same. The plate 24A can be arranged for rotation about a normal-axis on the surface or be movable in its own plane (arrow $P_1$) so that a random effect can be obtained. With this, rapidly and simply, an entire surface can be worked.

Figure 7B:
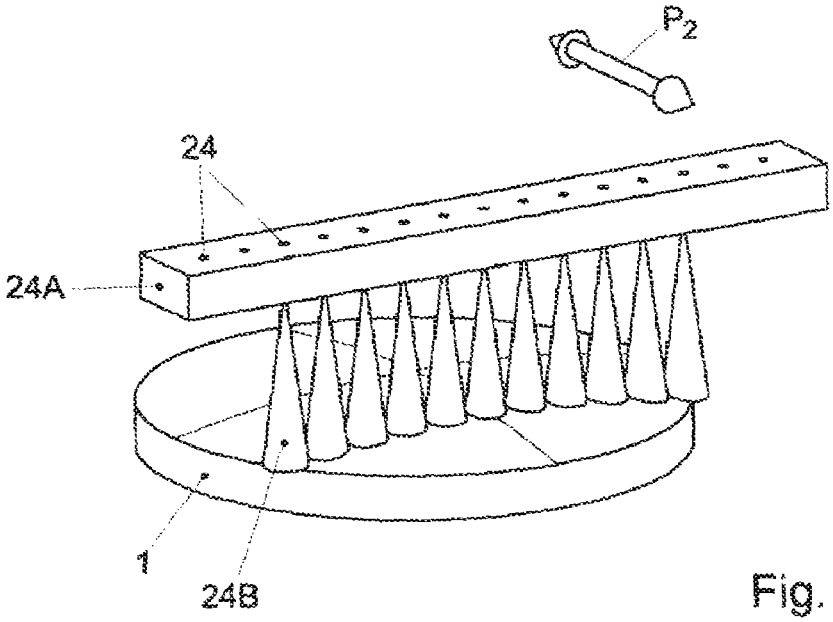

FIG. 7B shows an embodiment comparable to that shown in FIG. 7A, wherein, however, only one row of jet nozzles 24 is provided in a plate 24A. The plate and/or the object 1 are moved in the direction $P_2$ relatively to each other for obtaining the desired working. With this, rapidly and simply, a surface can worked and simple adjustment in the form can be obtained.

Figure 7C:
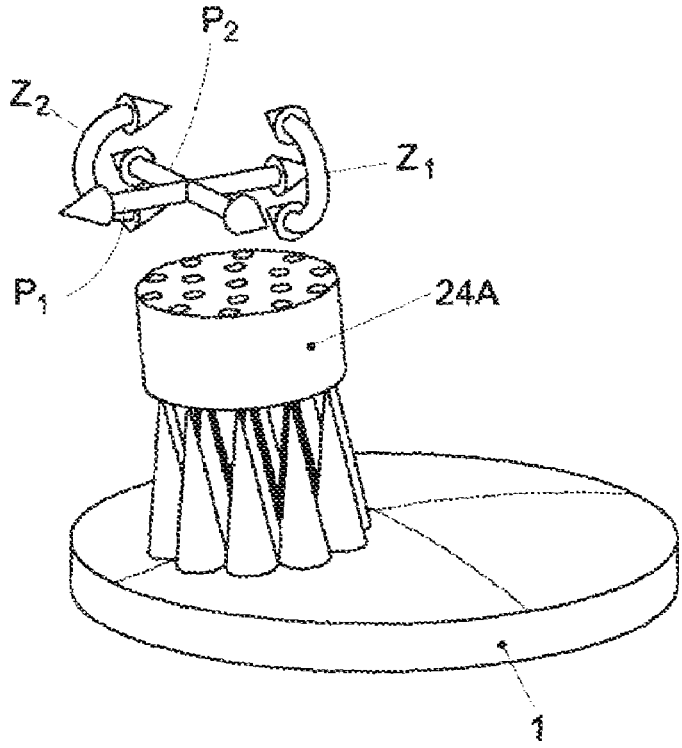

FIG. 7C shows an embodiment wherein the jet nozzles are provided in a plate 24A approximately in concentric circles. Here, the plate is preferably movable in two directions P1, P2 at right angles to each other, and pivotable in two direction Z1, Z2. As a result, a controlled movement of the plate and thus of the jets 24B over the surface is possible, so that forming the surface can be carried out in a rapid, simple and accurate manner.

Figure 7D:
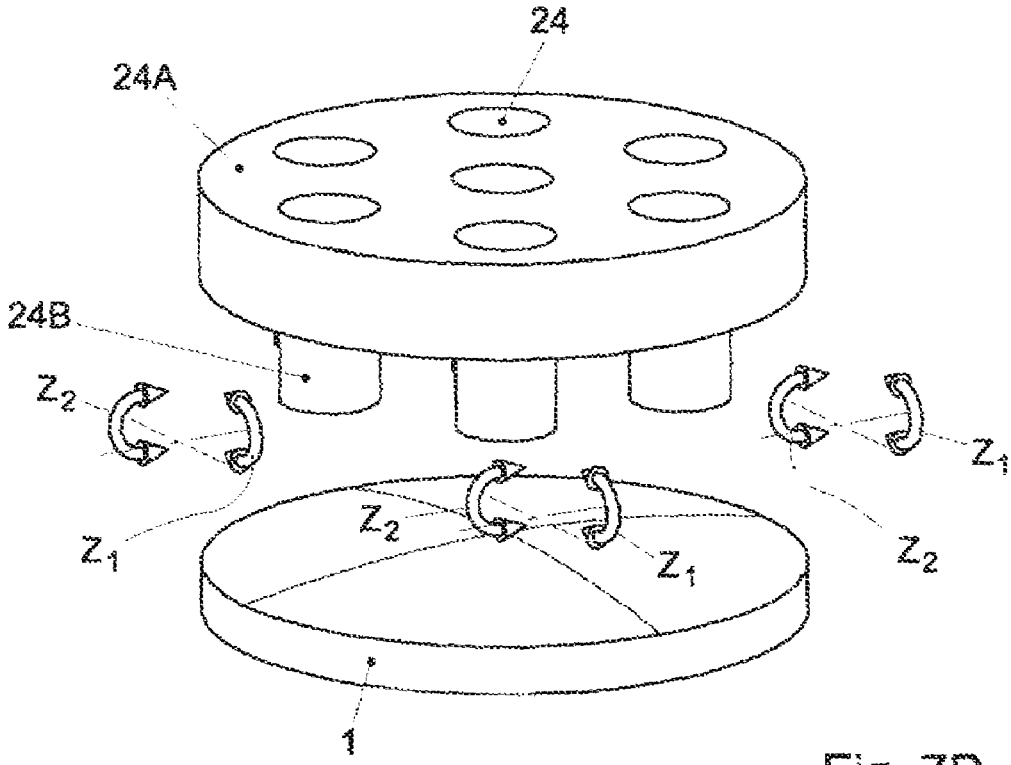

FIG. 7D shows an embodiment wherein, in a plate-shaped part 24A, a series of jet nozzles, individually drivable and adjustable at least in direction of jet and pattern is provided, so that with plate 24A and object 1 stationary or moving relative to each other, desired surface operations such as forming and finishing can be carried out. An advantage is that object and plate need not be moved.

With each of the embodiments as shown in FIG. 7, 7A-7D, if desired, the jet nozzles can be drivable individually or group-wise and be provided with, for instance, a control valve 25 and/or pump 23, connected to the control device 26. With this, the pattern of working can be controlled even better.

Figure 8:
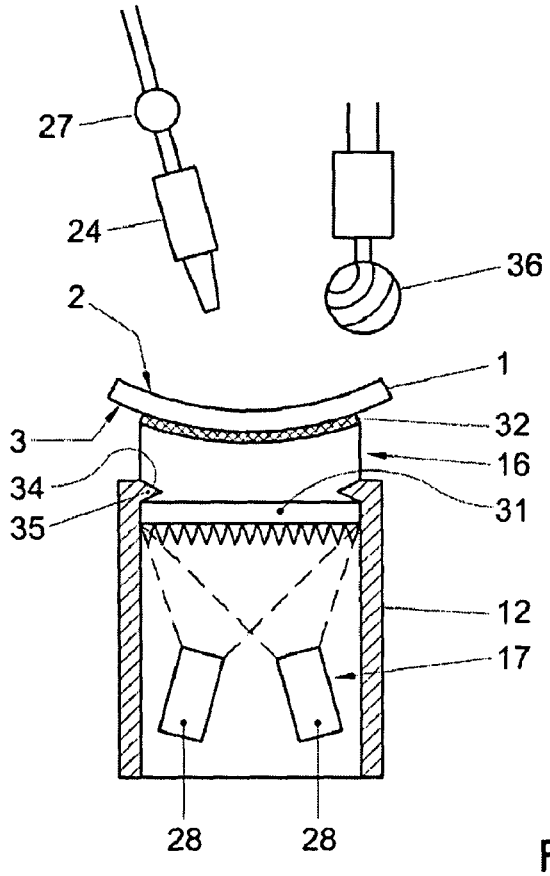
FIG. 8 schematically shows, in partly cross-sectional side view, a part of an apparatus according to the invention; in particular of a holder with measuring device and working means.
Figure 9:
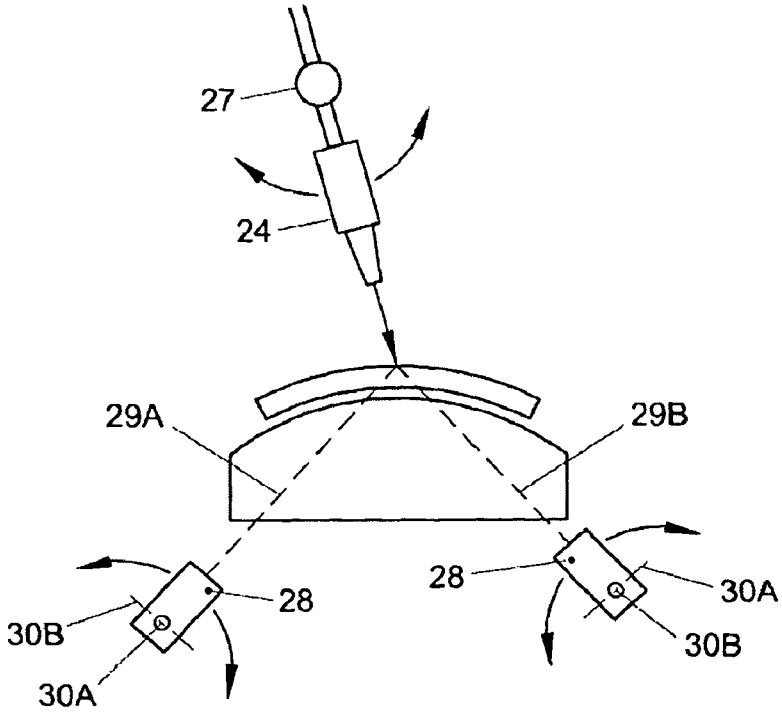
FIG. 9 schematically shows, in partly cross-sectional side view, a part of an apparatus according to the invention, in particular of an alternative embodiment of a holder with measuring device and working means.

When the optical object such as the pre-form 1 is being worked, with the aid of the measuring device 17, each time, there where an operation is carried out with the working apparatus and/or in the direct vicinity thereof, the change in the surface on which the operation is carried out is measured, preferably continuously. To that end, the measuring device is designed as a contactless measuring device such as an interferometric measuring device. A device can then be used with which the entire surface is measured virtually completely and in one go, as schematically shown in FIG. 8, or locally, as schematically shown in FIG. 9. Such measuring devices and methods are, for that matter, known per se and use changes in reflection and waves destroying or reinforcing each other, in particular light. Herewith, in particular, relative reductions in thickness of the optical element can be measured during working and preferably through the object, from a side on which no working operations are carried out. Preferably, the device 17 according to the invention is provided with means for establishing the initial position of the object, in particular the pre-form 1, on the holder 16, and for determining the original shape of the pre-form 1, for instance through the use of 3-D position determination, stereo photography or such methods known per se, so that, each time, from the relative changes in thickness and form the actual thickness and form are known, at least can be determined. What can be achieved with such a measuring device 17 is that during working, the pre-form 1, at least the optical element needs not be taken from the holder 16 but can be worked in a continuous process.

In the embodiment shown in FIG. 9, the device 17 is provided with two transmitter-receivers 28 for light, with which, through the holder 16, preferably of transparent design according to the invention, and the optical object 1 (the pre-form), light beams 29 can be transmitted and received. The light beams are at least partially reflected by the surface to be worked of the optical object 1, in the exemplary embodiment shown the second surface 3, so that, through interference of the two light beams 29A, 29B, the changes in form, in particular the changes in thickness can be determined, while moreover, the surface roughness can be determined and verified. The transmitter-receivers 28 can be pivoted about axes 30A, 30B, so that the entire surface 3 can be covered. The transmitter-receivers 28 and the nozzle 24 are driven by the control device 26 with which, on the basis of a desired profile entered into the control device 26, for each part of the surface 3, the device 10 can be controlled and can be adjusted in a continuous manner.

In the embodiment shown in FIG. 8, the device 17 is included in a hollow shaft 12, at least the transmitter-receivers 28. Adjacent the top end of the shaft, a lens or an assembly of lenses 31 is arranged, in particular a Fresnel lens 31, with which light of the transmitter-receivers 28 can be deflected through the transparent holder 16 and the optical object 1. The holder 16 is fixed in a known manner, schematically shown by the notches 34 and complementary protuberances 35. The optical object is attached to the holder 16 in a position retaining manner with the aid of an agent 32 suitable thereto such as an adhesive paste, while the holder functions as a blocker. Suitable as an agent 32, but not limited thereto is, for instance, resin curing under UV-light or due to temperature change. This agent 32 has a known refractive index, preferably matching and more preferably approximately equal to that of the holder 16. With such a configuration, directly through the holder 16, which, as a rule, is also indicated as blocker, an image of changes in form and thickness can be obtained of virtually the entire surface 2 to be worked, in a manner described hereinabove, on the basis of which the working apparatus 18, schematically indicated by a jet nozzle 24 of a device 19 or a milling device 36, can be driven.

In FIGS. 10A-E, five possible configurations are given for an apparatus 10 according to the invention, wherein at least one of the elements working apparatus 18, measuring device 17 and/or table 11 with holder 16 is moveably arranged with the aid of a robot arm.

Figure 10A:
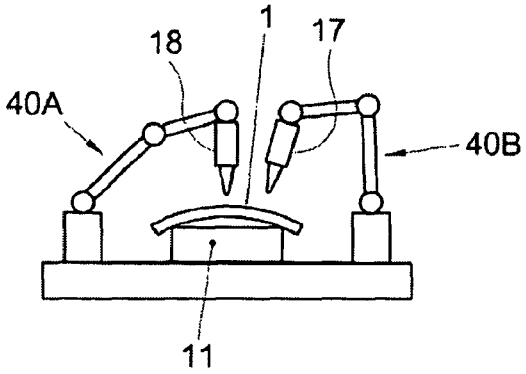
FIG. 10A-E show five configurations of set-ups of a working apparatus, a measuring device and a holder for an optical element or pre-form according to the invention.
Figure 10B:
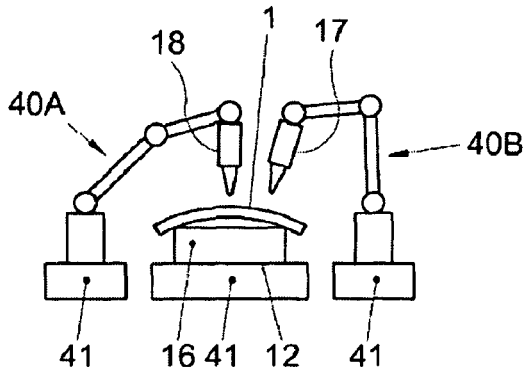

In the embodiment shown in FIG. 10A, working device 19, at least the jet nozzle 24 and the measuring device 17 are disposed on two separate robot arms 40A, B, while the table 11 with holder 16 is fixedly disposed. The robot arms 40 and the table 11 are arranged on the same foundation while means can be provided for damping and/or compensating vibrations generated by the working apparatus 18, for instance through vibration dampers in the foot 41 of the robot arms 40 and/or the table 11, or by active vibration compensation and/or damping. Such means are sufficiently known.

In the embodiment shown in FIG. 10B, again, two robots are provided for measuring device 17 and working device 18 but they are physically separated from each other and from the table 11, such that vibrations generated by the working device 18 are not taken over by the measuring device 17 and/or table 11 or vice versa.

Figure 10C:
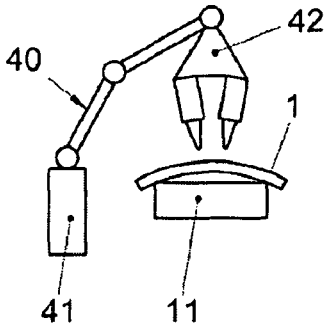

In the embodiment shown in FIG. 10C, the measuring device 17 and the working device 18 together are jointly fitted on a head 42 or a robot arm 40. In the head 42, vibration dampers and/or active vibration compensating means are then included for preventing reciprocal influencing. The table 11 is then fixedly arranged.

Figure 10D:
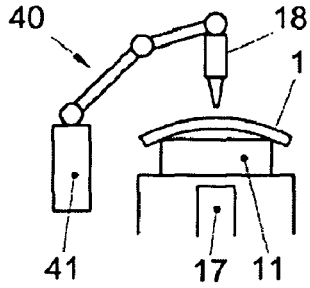

In the embodiment shown in FIG. 10D, the working device 18 is attached on a robot arm 40, while the table 11 with the measuring device 17 therein or therebelow is as shown in, for instance, FIG. 8 or 9.

Figure 10E:
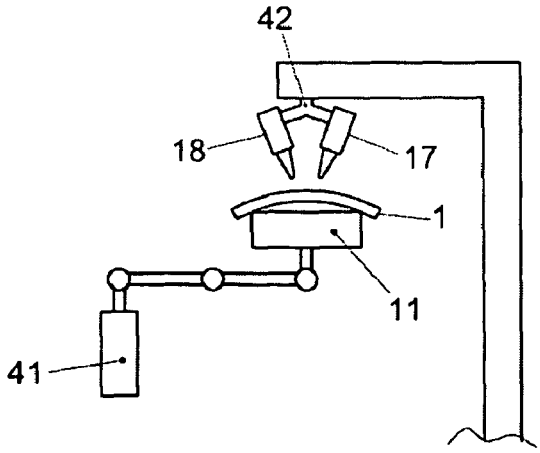

In the embodiment shown in FIG. 10E, the table 11 is attached to a robot arm 40 while the working device 18 and measuring device 17 are attached on a head 42 as shown in FIG. 10C, but here, the head 42 is fixedly disposed.

FIG. 11 schematically shows an alternative embodiment of an apparatus 10 according to the invention, with which virtually simply and preferably virtually fully automatically, an optical element such as a multifocal spectacle glass 50 (only shown by way of example) can be manufactured from a pre-form 1 as shown in, for instance, FIGS. 1-4. With this apparatus, in a housing 51 are provided, successively, a first working device 18A in the form of a milling device, a second working device 18B in the form of a fluid jet device 19, a third working device 18C, a coating and engraving device and a fourth working device 18D, a polishing device. Here, the holder 16 with at least a part of the measuring device 17 has been included in a transport means 52, schematically indicated by a trolley, movable over a rail 53, with which the pre-form 1 can be moved along the working devices 18A-D. However, it will be clear that many alternatives are possible to that end, for instance a carrousel, while naturally, also the working devices can be moved along a stationarily disposed table 11 with holder 16 and pre-form 1.

In a manner described hereinabove, a pre-form 1 is arranged on a holder- 16, on the transport means 52, above the measuring device 17. The starting form and position are determined and stored in a control unit 26, whereupon the transport means 52 is moved into the housing 51, as far as the first working device 18A. With this, if required, the first surface 2 of the pre-form 1 is worked. A milling device 54 for, substantially, the desired final shape is pressed into the first surface 2, so that substantially the desired configuration of the first surface 2A is obtained. Thereupon, the transport means 52 with the pre-form 1 is moved to the second working device, in which, with the jet nozzle or nozzles 24 the, optionally, milled surface is polished and/or a recess 7 or other local change in surface is provided. Optionally, blowing means (not shown) can be provided for removing grindings, fluid rests and the like.

Figure 13:
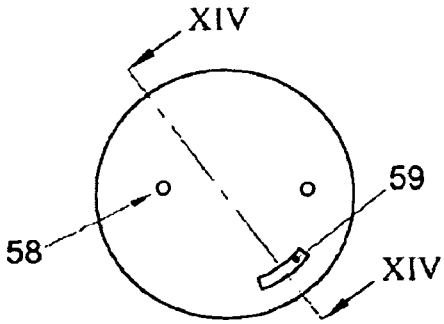
FIG. 13 shows, in top plan view, an optical element from which a lens can be taken, provided with coating and profiles.
Figure 14:
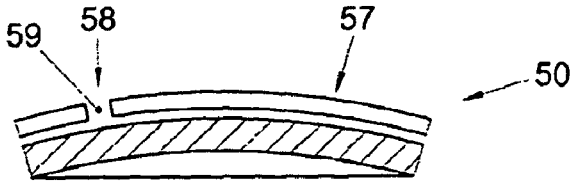
FIG. 14 shows, in cross-sectional side view, an element according to the line XIV-XIV of FIG. 13.

In the third working device 18C, means 55 can be provided for applying a coating, for instance for obtaining a reflective or, conversely, non-reflective layer. In this working device 18C, also a blasting device 19 can be provided with which the applied coating can be removed, at least locally, as schematically shown in FIGS. 13 and 14, for marking of the object 1, for instance for the purpose of determining position for the optician or other (eventual) user, or for commercial purposes, for instance branding.

Finally, the fourth working device 18D is provided with a grinding instrument 56 for cutting or grinding the pre-form 1 into the desired shape for obtaining the desired optical element 50. This can, for instance, be directly ready to be placed into a frame. To that end, one of the working devices 18, for instance the second, 18B, or the fourth, 18D, can be designed for, for instance, providing attachment holes for screws or other frame parts, grooves in a side of the lens 50 and the like.

It will be clear that in a working apparatus 10 according to FIG. 11, other numbers and types of working devices can be provided. For instance, the coating means 55 can be omitted or the holder can be designed such that another side of the pre-form can be worked, or both sides. In particular there, where pre-forms 1 are used as shown in FIGS. 1 and 3, a particularly simple holder 16 can be used, in which or on which the pre-form 1 is laid and is supported only along the outer contour. Accordingly, the accessibility of the two surfaces is increased.

Figure 12:
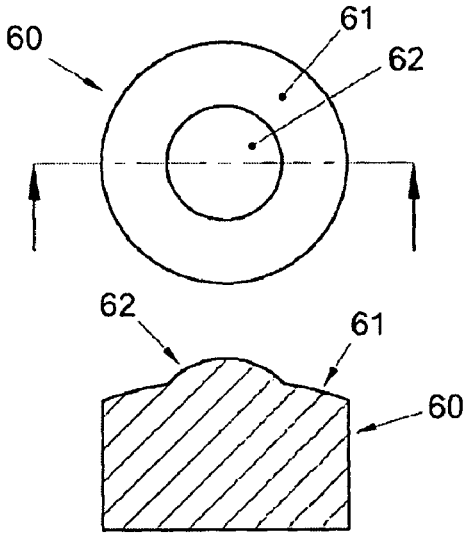
FIG. 12 shows, in top plan view and cross-sectional side view a first, male part of an optical forming element, in particular a mold for a contact lens.

In FIG. 12, as an example, an optic forming element 60 is shown, suitable for use when manufacturing lenses, in particular contact lenses. The male part of a mold is shown. In the forming surface 61, this is provided with a spherical surface 62 which is located slightly more elevated relative to the forming surface 61. Therefore, with it, while using for instance a female counterpart with a spherical concave surface, a lens can be formed with relatively thicker edges and a thinner central part, at least changing wall thickness. Bu using an apparatus according to the invention, such a forming surface with elevation can be manufactured particularly accurately and in a reproducible manner, at relatively low costs. Moreover, in a simple manner, two or more recesses (not shown) can be provided in a surface, in particular the convex surface of the mold, such that at the concave side of a lens to be formed therein, at least two spaced apart elevations are provided. During use, these elevations serve as positioning elements with which rotation on the eye is prevented. This is in particular of importance when the lenses are not rotation symmetrical.

In FIGS. 13 and 14, in top plan view and in cross-sectional side view, a lens 50, at least optical element from which a lens 50 can be cut is shown, provided with a coating 57 with marking points 58 therein and an engraved name 59, for instance a brand, a type indication or the like. With an apparatus according to the invention such a marking or branding can simply be provided in that the thickness of the coating layer can be determined very accurately and the working apparatus, in particular the blasting device 19, can be driven such that only the coating is removed and not a part of the surface on which this has been applied.

With an apparatus 10 according to the invention, in particular as shown in FIG. 11, virtually instantaneously and from a limited number of pre-forms, an optician or such can manufacture a wide variety of glasses and lenses which can be directly placed into a frame. Moreover, these lenses can be mono as well as bifocal and be individually adjusted. Optionally, the apparatus 10, in particular the control device 26 can be designed such that at any moment the user can observe the progression and/or influence the working.

Naturally, when using, for instance, overmold or undermold techniques, an object 1 to be worked can also be engaged at the peripheral edge so that both the convex and the concave surface are free to be worked.

It will be clear that with an apparatus according to the invention or methods or forming elements described herein such as molds for pre-forms or lenses can be formed and/or worked, for instance for aspherical or toric adjustments of forming surfaces. Also, differently shaped lenses can be made to fit an end user with a method or apparatus according to the invention, for instance individualized and/or to fit a frame.

The invention is not limited in any manner to the exemplary embodiments represented in the description and the drawing. Many variations thereon are possible within the framework of the invention as outlined by the claims.

For instance, many other types and forms of pre-forms can be worked with an apparatus or method according to the invention, for instance colored, hardened or with a different starting form. Also, reflective layers can be provided and worked. By varying the angle between the jet of the fluid jet device and the surface to be worked, the abrasive action can be influenced and a strongly material-removing or not strongly material-removing or a polishing function for that matter can be obtained. As a result of this too, with an apparatus or method according to the invention, any desired working can be carried out, which, each time in situ, can be registered and adjusted. Customary polishing means such as polishing heads and polishing pads can be used in addition to or instead of the fluid jet polishing device, for instance for rapidly polishing large surfaces, while the blasting device is used for highly curved and/or irregularly formed and/or locally relatively deep surface parts. Also other measuring devices can be used and, for instance, a holder can be used having specific light-passing openings for the measuring device. As schematically shown in FIG. 10, the measuring device can also be designed to be placed above the surface to be worked. For instance, measurement of thickness and changes of thickness can then also be measured by reflection on the opposite surface and/or a surface of the holder. Other means can be provided for holding the pre-form during working, for instance clamping means.

All combinations of parts of exemplary embodiments shown and/or described here are understood to fall within the framework of the invention as outlined by the claims.

What is claimed is:

1. An apparatus for forming or working optical objects, comprising a working device, at least one measuring device and a control device, the working device being adapted to form a surface of the optical object by machining or abrading, the at least one measuring device is adapted to measure changes in form and/or surface roughness of the surface during the surface being formed, the measuring device being further adapted to provide measuring data to the control device, the control device being adapted to control said working device on the basis of the measuring data, wherein at least one holder is provided for holding the object to be worked in the apparatus, which holder is at least partly translucent while at least one light source and at least one light receiver are disposed adjacent said holder, such that during use, light from said light source can be sent through said holder and an element located thereon and at least light from the light source reflected by the surface to be worked can be captured by said light receiver, while measuring means are provided for determining absolute and/or relative changes in the surface of said object to be worked from said reflected light captured in said light receiver.

2. An apparatus according to claim 1, wherein the measuring device is designed for measuring said changes in form with the aid of light beams.

3. An apparatus according to claim 2, wherein the measuring device is designed for measuring said changes in form with the aid of interference measurement.

4. An apparatus according to claim 2, wherein the measuring device is designed for measuring changes in roughness.

5. An apparatus according to claim 4, wherein the measuring device is designed for measuring the changes in roughness through scatterometry.

6. An apparatus according to claim 1, wherein said working apparatus is provided with at least one jet nozzle, the jet nozzle being able to dispense under pressure, a blasting agent for removing surface material through abrasive action, such that as a result thereof desired change in form and/or surface roughness is obtained.

7. An apparatus according to claim 6, wherein said working apparatus is designed for blasting, under a pressure of between 4 and 100 bar, a blasting agent against a surface to be worked.

8. An apparatus according to claim 7, wherein the pressure is between 4 and 25 bar.

9. An apparatus according to claim 8, wherein the pressure is between 5 and 10 bar.

10. An apparatus according to claim 7, wherein the blasting agent is a mixture or suspension of a liquid such as water and an abrasive agent such as sand or glass or such solid substance.

11. An apparatus according to claim 1, wherein the holder is provided with a surface for attachment of said object with the aid of a blocking compound which is translucent, such that a first surface of the element facing away from the holder can be worked with the working apparatus while, at the opposite side of the object, light can be sent through the holder and through the object to be worked.

12. An apparatus according to claim 1, wherein in the holder at least one optical element such as a lens is included, in particular a Fresnel lens, while one or more light sources and light receivers are arranged below the holder for reflecting light through the holder against the surface of the object to be worked, while the holder has dimensions such that it is substantially covered by the element.

13. An apparatus according to claim 1, wherein the apparatus comprises at least milling means, grinding means and/or polishing means, while at least the grinding means and/or the polishing means comprise fluid jet polishing means.

14. An apparatus according to claim 1, wherein further, a device is provided for grinding the respective object, designed as a lens, into a frame, while abrasive working means are provided for locally working at least one part of at least one surface of the respective object, the arrangement being such that the respective object is substantially concave, while the respective part is substantially convex.

15. An apparatus according to claim 1, wherein the apparatus is provided with means for insulating the measuring device against vibrations in relation to the working device such that, when the optical object is being worked, the measuring results of the measuring device are not affected by vibrations caused by the working apparatus.

16. An apparatus according to claim 15, wherein the means for insulating against vibrations comprise active and/or passive damping means.

17. An apparatus according to claim 15, wherein the working device comprises a first arm, arranged so as to be insulated against vibrations relative to a holder for the element to be worked and the measuring device.

18. An apparatus according to claim 17, wherein the measuring device is provided, at least partly, on a second arm.

19. An apparatus according to claim 1, wherein the working device is provided with at least one series of blowing openings through which, during use, a fluid with a grinding agent can be blown out under pressure, for abrasively working a surface.

20. An apparatus according to claim 19, wherein in different blowing openings of the series of blowing openings select ones of flow rate, pressure, outflow velocity and outflow profile are actively controlled, depending on the measuring data registered by the measuring device.

21. An apparatus for forming or working an optical object, the apparatus comprising:

a working device for forming a surface of the optical object by machining or abrading;

at least one measuring device for measuring changes in at least one of form and surface roughness of the surface while the surface is being formed; and a control device for controlling said working device on the basis of the measuring data, the measuring device providing measuring data to the control device, wherein the working device is provided with at least one series of blowing openings through which, during use, a fluid with a grinding agent can be blown out under pressure, for abrasively working a surface, wherein select ones of flow rate, pressure, outflow velocity and outflow profile are actively controlled from different blowing openings of the series of blowing openings, depending on the measuring data registered by the measuring device.

* * * * *

UNITED STATES PATENT AND TRADEMARK OFFICE

CERTIFICATE OF CORRECTION

PATENT NO. : 7,556,554 B2
APPLICATION NO. : 10/541003
DATED : July 7, 2009
INVENTOR(S) : Brug et al.

It is certified that error appears in the above-identified patent and that said Letters Patent is hereby corrected as shown below:

| | | |
|---|---|---|
| Column 2, Line 4, | now reads | "non-machine folding tools" |
| | should read | -- non-machine forming tools -- |
| Column 4, Line 29, | now reads | "white furthermore" |
| | should read | -- while furthermore -- |
| Column 11, Line 27, | now reads | "Bu using an apparatus" |
| | should read | -- By using an apparatus -- |

Signed and Sealed this

Third Day of November, 2009

David J. Kappos

David J. Kappos
*Director of the United States Patent and Trademark Office*